United States Patent [19]

Annovi

[11] Patent Number: 4,461,103

[45] Date of Patent: Jul. 24, 1984

[54] SKI BOOT WITH AN ELASTICALLY INCLINABLE LEG PORTION

[75] Inventor: Giuseppe Annovi, Montebelluna, Italy

[73] Assignee: Dolomite S.p.A., Montebelluna, Italy

[21] Appl. No.: 303,592

[22] Filed: Sep. 18, 1981

[30] Foreign Application Priority Data

Dec. 15, 1980 [IT] Italy ..... 61981/80[U]

[51] Int. Cl.[3] ..... A43B 5/04; A43B 5/00

[52] U.S. Cl. ..... 36/121; 36/117; 36/118

[58] Field of Search ..... 36/121, 118, 117, 109, 36/132, 136

[56] References Cited

FOREIGN PATENT DOCUMENTS

| | | | |
|---|---|---|---|
| 1816811 | 6/1970 | Fed. Rep. of Germany | 36/121 |
| 197804 | 3/1978 | France | 36/132 |
| 2476455 | 8/1981 | France | 36/117 |

*Primary Examiner*—Werner H. Schroeder
*Assistant Examiner*—Steven N. Meyers
*Attorney, Agent, or Firm*—D. Paul Weaver

[57] ABSTRACT

A ski boot consists of a foot portion and a leg portion connected in articulated relationship. A stiffening element at the front of the boot formed of resilient material has substantially the profile of the boot and is attached at least partially to the foot portion and/or the leg portion thereof.

4 Claims, 2 Drawing Figures

SKI BOOT WITH AN ELASTICALLY INCLINABLE LEG PORTION

Background of the Invention

This invention relates to a ski boot having an elastically inclinable leg portion.

Ski boots are well known which comprise a rigid foot portion formed of injection molded plastics material, and having a flat rigid sole. A drawback of such boots is that the leg portion affords limited flexure of the skier's leg, and slow elastic return to the natural position after bending.

In order to eliminate this drawback, it has been proposed in the prior art that the foot portion near its back be connected to the leg portion through variable strength spring devices or absorbers having rubber caps. However, this solution presents other drawbacks, and in particular:

1. Lack of reliability in both stages of flexure and extension;
2. High cost not only due to the presence of these additional devices, but also due to the difficulty in mounting them;
3. Certain encumberance at the back; and
4. Difficult replacement in case of breakage.

Furthermore, such springs or absorbers are not usable in monoblock boots, that is, in boots without articulation between the foot and leg portions.

All of these drawbacks are eliminated by the invention through provision of a ski boot having an elastically inclinable leg portion provided with a stiffening element at the front, substantially shaped according to the profile of the boot, and formed from an elastically pliable material and being attached at least partially to the foot portion and/or leg portion of the boot. Advantageously, the ski boot according to the invention can include at least a pair of slides to maintain the stiffening element substantially on the longitudinal median plane of the boot.

The stiffening element preferably has at least one of its ends fixed with respect to the boot. The fixing means between the stiffening element and boot can be a screw or bolt connection.

The stiffening element can also have a coupling part engaged in a slit formed in the upper edge of the boot itself. In a different embodiment, the stiffening element can have an end inserted in a corresponding recess of the foot portion.

The present invention can be further understood with reference to the accompanying drawing.

Detailed Description

Figure 1:
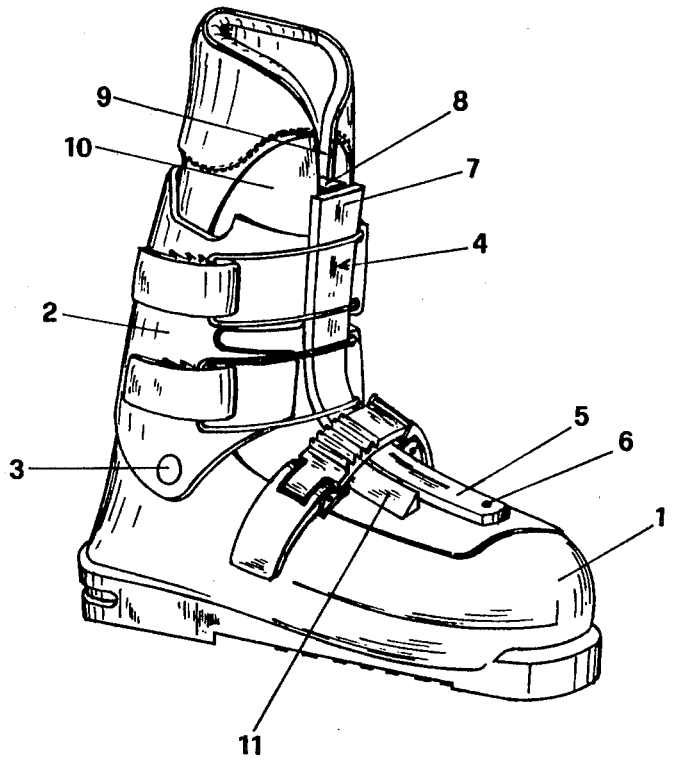
FIG. 1 is a perspective view of a ski boot having a front stiffening element according to the invention.

Referring to the drawings in detail wherein like numerals designate like parts, a ski boot is formed from plastics by injection molding and comprises a foot portion 1 and a leg portion 2 joined to the foot portion by articulation means 3 near the ankle.

At the front of the boot and shaped according to the profile thereof is a stiffening element 4, preferably formed of plastics or metal or glass fiber reinforced material. The stiffening element 4 is substantially L-shaped including straight end portions connected by a curved portion having a bending radius greater than the bending radius of the boot profile, such that the connection between the element 4 and the boot comes only at the end portions of the element 4, the remainder of the element being somewhat spaced from the boot. In particular, the front end 5 of the stiffening element is connected to the foot portion 1 by a screw 6, and the rear end 7 is provided with a coupling strip or key 8 engaging in a slit 9 formed in the upper part of the tongue 10.

Provided on the foot portion 1 is a pair of spaced positioning elements or slides 11 which straddle the stiffening element 4 and maintain it at the longitudinal median plane of the boot.

In a modified embodiment, not shown in the drawings, the element 4 is fixed to foot portion 1 by insertion of its forward end in a locator portion or recess provided for this purpose.

Figure 2:
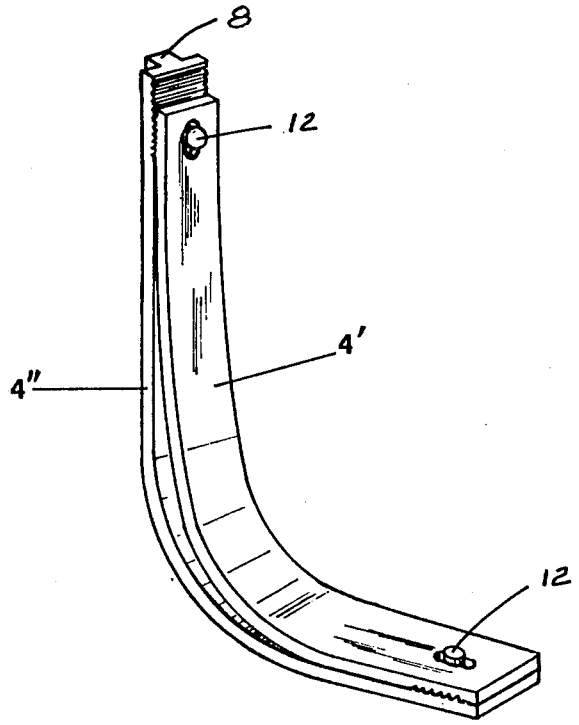
FIG. 2 is a perspective view of a front stiffening element according to a modification of the invention.

As shown in FIG. 2 depicting a modification, the stiffening element may be embodied in at least two separate portions 4', 4'' connected to each other near the opposite ends of the stiffening element by fastener means 12 and being adjustable to allow varying of the bending radius of the stiffening element.

From the above, it is clear that the ski boot according to the invention presents many advantages including in particular:

1. Resilient return of the leg portion of the boot to the rest position without increase in encumberance at the back of the boot;
2. Efficient contrast action in the stage of flexure of the skier's leg and a quick resilient return in the following stage of extension;
3. The possibility of application of the invention to pre-existing boots without substantial modification of the molds;
4. Simple and economical replacement of the stiffening element in case of breakage.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a ski boot, an elastically inclinable leg portion, a stiffening element on the front of the boot having substantially the profile of the boot and being resilient, means attaching at least one end of the stiffening element to the boot, and a coupling part on the rear of the stiffening element engageable interlockingly with a slit formed in the leg portion.

2. In a ski boot, an elastically inclinable leg portion, a stiffening element on the front of the boot having substantially the profile of the boot and being resilient, means attaching the stiffening element partially to the leg portion and/or the foot portion of the boot, and the stiffening element being a spring-like bar element having substantially straight end portions adjacent to the leg and foot portions of the boot and a connecting radius portion of greater radius than the adjacent radius of the boot between its leg and foot portions.

3. In a ski boot as defined in claim 2, and said stiffening element comprising at least a pair of elongated bar elements in stacked relationship, and means adjustably interconnecting said bar elements near their ends, whereby the bending radius of the stiffening element may be varied.

4. In a ski boot, an elastically inclinable leg portion, a stiffening element on the front of the boot having substantially the profile of the boot and being adherent to and substantially coextensive lengthwise with the tongue of the boot substantially for the entire length of the tongue, and means attaching the stiffening element partially to the leg portion and/or foot portion of the boot.

* * * * *